United States Patent [19]

Yamamoto et al.

[11] 4,287,850

[45] Sep. 8, 1981

[54] MAGNETIC BRUSH DEVELOPING APPARATUS

[75] Inventors: Toshio Yamamoto; Shizuo Yuge, both of Toyokawa, Japan

[73] Assignee: Minolta Camera Kabushiki Kaisha, Osaka, Japan

[21] Appl. No.: 884,184

[22] Filed: Mar. 7, 1978

[30] Foreign Application Priority Data

Mar. 22, 1977 [JP] Japan ..... 52-31719

[51] Int. Cl.[3] ..... G03G 15/09

[52] U.S. Cl. ..... 118/657; 118/647; 118/648; 355/3 DD; 430/122

[58] Field of Search ..... 355/3 DD; 346/74.1; 427/18; 430/39, 120, 122; 118/654, 655, 656, 657, 647, 648

[56] References Cited

U.S. PATENT DOCUMENTS

| | | | |
|---|---|---|---|
| 3,611,982 | 10/1971 | Coriale et al. | 118/648 |
| 3,879,737 | 4/1975 | Lunde | 118/657 |
| 3,926,516 | 12/1975 | Whited | 118/657 |
| 4,015,561 | 4/1977 | Howard et al. | 427/18 |
| 4,122,209 | 10/1978 | Kinard | 118/657 |

FOREIGN PATENT DOCUMENTS

| | | | |
|---|---|---|---|
| 50-3344 | 5/1973 | Japan | 118/648 |

*Primary Examiner*—Edward C. Kimlin
*Assistant Examiner*—John L. Goodrow
*Attorney, Agent, or Firm*—Wenderoth, Lind & Ponack

[57] ABSTRACT

A magnetic brush developing apparatus for use in a toner powder image transfer type electrophotographic copying machine which includes an outer cylinder fixedly disposed at a position to confront a photosensitive member or photoreceptor, a magnet roller rotatably accommodated in the outer cylinder for being rotatably driven, a toner tank or hopper containing therein electrically conductive and magnetically attractive toner particles having high resistance and disposed above the outer cylinder for supplying the toner particles onto the outer cylinder, an excessive developing region for developing an image portion of an electrostatic latent image formed on said photosensitive member with sufficient density, and a toner removing region for removing toner particles adhering at least to non-image portion of the electrostatic latent image.

18 Claims, 6 Drawing Figures

MAGNETIC BRUSH DEVELOPING APPARATUS

BACKGROUND OF THE INVENTION

The present invention relates to electrophotography and more particularly, to a magnetic brush developing apparatus for use in an electrophotographic copying machine of the toner powder image transfer type employing electrically conductive and magnetically attractive toner particles having high resistance.

Recently, intensive studies have been made of developing apparatus employing a mono-component developer developing method, since such one component toner is not subject to variation in the mixing ratio of the toner particles and carrier material as in a two component developer, with consequent facilitation of the maintenance of the copying machines.

While the developing method employing a mono-component developer as described above is effective for a direct type copying machine such as a so-called electrofax type, it causes various problems when applied to toner powder image transfer type copying machines. More specifically, in toner powder image transfer type copying machines, when the developing and transfer are effected with low resistance magnetically attractive toner used for a direct type copying machine, resultant images are affected by "dimming or hazing" i.e. indefinite contour at the time of transfer, although the developing is favorably carried out with high density. Such a disadvantage as described above is considered to be possibly attributable to the phenomenon that, because of the low resistance of the toner particles charge imparted to a transfer material or copy paper is poured into the toner particles, when the toner particles are transferred onto the copy paper, so that the copy paper and the toner particles are given the same polarity, with the result that the toner particles once transferred onto the copy paper are again repelled from said copy paper or repelled to the surrounding portion of the image formed on the copy paper. Therefore, such a mono-component developer for use in toner powder image transfer type copying machines should have a high resistance. However, if such high resistance magnetically attractive toner particles are employed in conventional magnetic brush developing apparatuses, there is an inconvenience that the density of the copied images tends to be low, since in such conventional magnetic brush developing apparatuses, the magnetic binding force acting on the toner particles is comparatively large.

In order to overcome the drawback as described above, there has heretofore been proposed, for example, in Japanese Laid Open Patent Application No. 51-105345, a developing apparatus in which the developing time is made comparatively long for obtaining copied images of high density, which developing apparatus, however, also has a disadvantage that undesirable fogging is produced in the non-image portion resulting in deterioration of the quality of copied images.

SUMMARY OF THE INVENTION

Accordingly, an essential object of the present invention is to provide a magnetic brush developing apparatus for use in an electrophotographic copying machine of the toner powder image transfer type employing a mono-component developing material composed of high resistance magnetically attractive toner particles which is capable of producing superior copied images of high density free from fogging in the non-image portion, with substantial elimination of the disadvantages inherent in the conventional developing apparatuses of this kind.

Another important object of the present invention is to provide a magnetic brush developing apparatus of the above described type which has a simple construction and which functions accurately, and can be incorporated into the copying machines of this kind at low cost.

For accomplishing these and other objects, according to the present invention, there is provided a magnetic brush developing apparatus for use in a toner powder image transfer type electrophotographic copying machine which includes an outer cylinder fixedly disposed at a position to confront a photosensitive member or photoreceptor, a magnet roller rotatably accommodated in said outer cylinder for being rotatably driven, a toner tank or hopper containing therein a mono-component developing material composed of magnetically attractive toner particles and disposed adjacent the outer cylinder for supplying the toner particles onto the outer cylinder, an excessive developing region for developing the image portion of an electrostatic latent image formed on said photosensitive member with sufficient density, and a toner removing region for removing toner particles adhering at least to the non-image portion of the electrostatic latent image. The excessive developing region is located upstream of the position at which the surface of said outer cylinder is closest to the surface of said photosensitive member and includes a developing electrode provided on said outer cylinder to confront the surface of said photosensitive member at an approximately equal distance, while the toner removing region is located at a position downstream of said excessive developing region and between said outer cylinder and said photosensitive member for removal of the toner particles adhering to the non-image portion magnetically and/or electrically. More specifically, in the arrangement according to the present invention as described above, attention has been directed to the fact that, although the toner particles attracted to the latent image portion on the surface of the photosensitive member are coupled to the charge of the latent image through a strong coulomb force, toner particles attracted onto the non-image portion and responsible for the undesirable fogging are adhering thereto only through an extremely weak coulomb force or merely through a mechanical force and can be readily removed by externally applying a biasing voltage having a polarity to suppress the degree of the developing. By the employment of the mono-component developing material composed of high resistance toner particles to be described more in detail later, the image portion is first developed to a rather excessive extent, with adhesion of some toner particles to the non-image portion being neglected at this stage, and subsequently, such toner particles adhering to the non-image portion which give rise to the undesirable fogging in the copied images are removed for providing superior copied images of high density free from the fogging in the non-image portion.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 1:
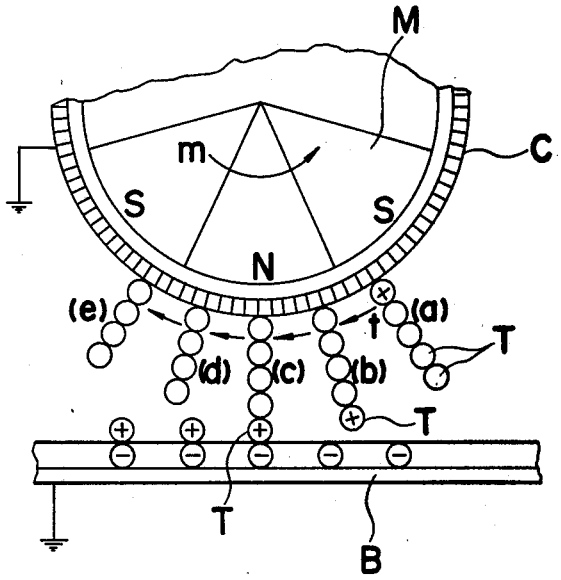
Fig. 1 Prior Art
FIG. 1 is a schematic sectional view, partly broken away, of a conventional magnetic brush developing apparatus for explaining the principle of the developing method employing a mono-component developer.

Referring to FIG. 1 for explaining the principle of the developing method employing a mono-component developer of magnetically attractive toner particles, the conventional magnetic brush developing apparatus includes an outer cylinder or sleeve C of electrically conductive material fixedly disposed in a position adjacent to and confronting a photosensitive member or photoreceptor B on which an electrostatic latent image is formed in a known manner, and a permanent magnet member or magnet roller M constituted by sequentially arranging a plurality of magnets in alternating polar orientations and rotatably disposed in the outer cylinder C for rotation in the direction shown by the arrow m. Magnetically attractive toner particles T of electrically conductive material are formed, upon counterclockwise rotation of the magnet member M, into magnetic brush bristles on the outer cylinder C by the magnetic binding force of the magnet member M and move clockwise along the surface of the outer sleeve C in the direction shown by the arrows t. When the tip of a magnetic brush bristle of the toner particles T thus formed approaches the latent image portion having a negative charge ⊖ on the photoreceptor B as shown at (a), a charge of opposite polarity ⊕ is induced on the outer sleeve C. As the tip of the magnetic brush bristle further advances so as to be brought into contact with the latent image portion of the photoreceptor B as shown at (b), the charge on the outer cylinder C rapidly moves through the chain of the toner particles T to reach the outermost one of said toner particles due to an increase in the electric field, with consequent generation of a static electric force acting with respect to the charge of the latent image, and thus the charge of the outermost toner particle disappears, when combined with the charge of the latent image as shown at (c). Since the magnetic binding force of the magnet member M is constantly acting on the toner particles T, when the electric force of the electrostatic latent image is larger than the magnetic binding force, the toner particles T leave the chain thereof as shown at (d) and (e), and are attracted onto the surface of the photoreceptor B for developing said latent image into a visible toner powder image. Meanwhile, in the non-latent image portion on the photoreceptor B at which the latent image portion is not formed, there is only a small electrostatic force, the magnetic binding force of the magnet member M remains larger than such force, and the toner particles T remain attracted to the magnet M and do not develop such non-latent image portion.

It should be noted here that the mono-component developer composed of high resistance magnetically attractive toner employed in the present invention is one which is selected from electrically conductive and magnetically attractive toners applicable to development according to the principle of the developing method as described above but which has comparatively high resistivity so as to be employable for transfer even by the known ordinary corona transfer.

Accordingly, excessive development may be effected either by reducing the magnetic binding force or by applying a biasing voltage to increase the coulomb force. On the contrary, for removing the toner particles adhering to the non-latent image portion and which give rise to the undesirable fogging, the magnetic binding force may be increased or the biasing voltage may be so impressed as to reduce the coulomb force. It is to be noted here that for effecting excessive developing or removal of toner particles responsible for the fogging from the non-latent image portion, a number of countermeasures as described above may be combined in various ways as in the embodiments according to the present invention described hereinbelow.

Figure 2:
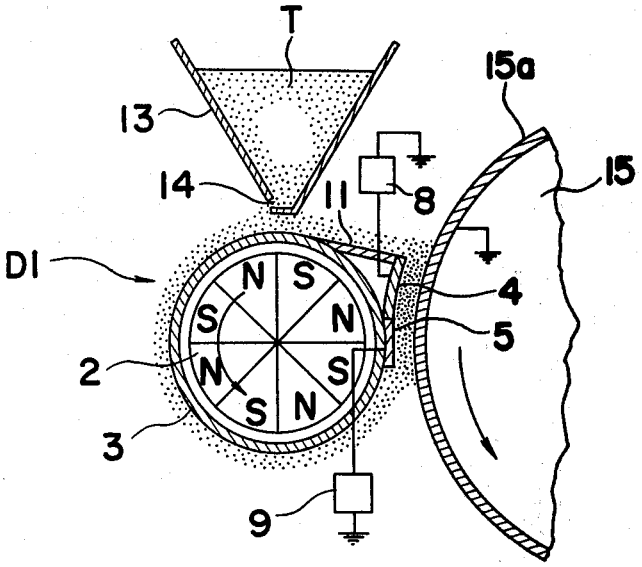
FIG. 2 is a schematic sectional view showing the arrangement of a magnetic brush developing apparatus according to one preferred embodiment of the present invention.

Referring now to FIGS. 2 to 6, there is shown in FIG. 2, a magnetic brush developing device D1 according to one preferred embodiment of the present invention. The developing device D1 generally includes a stationary outer cylinder or sleeve 3 disposed in a position adjacent to and spaced from the known photosensitive or photoreceptor surface 15*a* of a photoreceptor drum 15 which is adapted to rotate counterclockwise in the direction indicated by the arrow, a permanent magnet member or magnet roller 2 constituted by a plurality of magnets, for example, eight in number in this embodiment arranged in alternating polar orientations and rotatably accommodated in the outer cylinder 3 for counterclockwise rotation in the direction indicated by the arrow, a developing electrode 4 and a toner removing electrode 5 for removing toner particles adhering to the non-latent image portion and which are responsible for the undesirable fogging, and a toner tank or hopper 13 containing therein a mono-component developer composed of high resistance magnetically attractive toner particles and disposed above the outer cylinder 3 for supplying the toner particles T onto the outer cylinder 3.

The developing electrode 4 having a contour generally conforming to the photoreceptor surface 15*a* of the drum 15 to form an excessive developing region is fixedly disposed in the space between the outer cylinder 3 and the photoreceptor surface 15*a* in a position where the electrostatic latent image formed on the photoreceptor surface 15*a* is brought close to the outer cylinder 3 as the photoreceptor drum 15 rotates. The lower end of the developing electrode 4 is kept in contact with the surface of the outer cylinder 3, while the upper end thereof is fixed to the outer cylinder 3 by a fixing plate 11 so as to be spaced from the surface of the cylinder 3. Meanwhile, the toner removing electrode 5 forming a region for removing toner particles responsible for the undesirable fogging in the non-image portion is disposed at a position downstream of the developing electrode 4, i.e., at a position in the direction of movement of the toner particles T subsequent to said developing electrode 4 and where the surface of the outer cylinder 3 is brought closest to the photoreceptor surface 15*a*. A biasing voltage source 8 is connected to the developing electrode 4 for expediting excessive developing, while the toner removing electrode 5 is coupled with another biasing voltage source 9 for suppressing the developing action. The biasing voltage sources 8 and 9 are connected in such a manner that when the electrostatic latent image formed on the photoreceptor surface 15*a* has a negative charge, the developing electrode 4 is positive and the toner removing electrode 5 negative with respect to the reverse surface of the photoreceptor surface 15*a*. The potentials of such biasing voltage sources 8 and 9 are so determined that, taking into account the balancing of the magnetic binding force with the coulomb force, developed images of sufficiently high density are available at the latent image portion of the photoreceptor surface 15*a* by overlooking, to a certain extent, adhesion of toner particles T responsible for the fogging and which are in the non-latent image portion, while at the toner removing electrode 5, such potentials are set so as to be sufficient to remove the toner particles T attracted onto the non-image formed portion.

On the other hand, the toner hopper 13 disposed above the outer cylinder 3 has a replenishing opening 14 at the lower portion thereof through which the high resistance magnetically attractive toner particles T contained in the hopper 13 are supplied to the surface of the outer cylinder 3, and, as the magnet member 2 rotates counterclockwise in the stationary outer cylinder 3, the toner particles T thus supplied are formed into magnetic brush bristles which are moved over the outer cylinder 3 in a clockwise direction sequentially along the fixing plate 11, developing electrode 4, toner removing electrode 5 and along the surface of the outer cylinder 3 for developing the electrostatic latent image formed on the photoreceptor surface 15*a* into the visible toner powder image.

Needless to say the toner removing electrode 5 described as employed in the above embodiment may be dispensed with, if the electrically conductive outer cylinder 3 is arranged to serve the purpose as in the modifications described hereinbelow.

Figure 3:
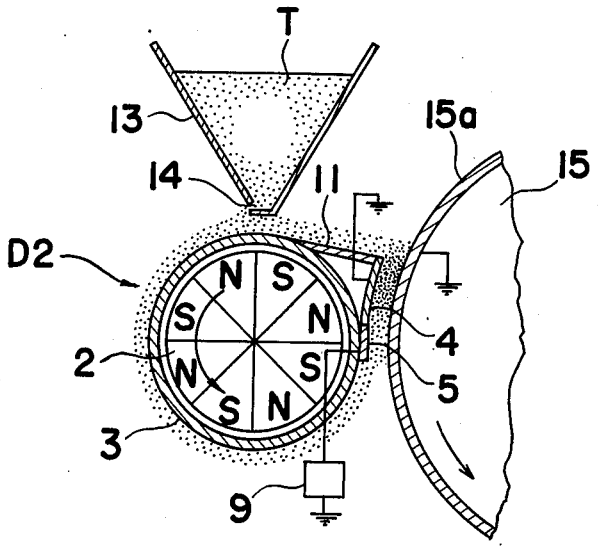
FIG. 3 is a view similar to FIG. 2, but particularly shows a modification thereof.

Referring particularly to FIG. 3, there is shown a modification of the developing apparatus D1 of FIG. 2. In the developing apparatus D2 of FIG. 3, the developing electrode 4 described as connected to the biasing voltage source 8 in the embodiment of FIG. 2 is modified to be directly connected to the ground, while the toner removing electrode 5 is connected to the biasing voltage source 9 for imparting a developing suppression bias to said electrode 5 in a similar manner to that described in connection with FIG. 2. On the other hand, the magnet member 2 has a magnetic binding force only sufficient to form the magnetic brush bristles of the toner particles T, and the developing electrode 4 is positioned at a position whereat at which the magnetic binding force of the magnet member 2 is weak, with the upper end of the electrode 4 being supported in a position spaced from the surface of the outer cylinder 3 by the fixing plate 11. Since other construction and function of the developing apparatus D2 are the same as those of the developing apparatus D1 of FIG. 2, detailed description thereof is abbreviated for brevity.

Figure 4:
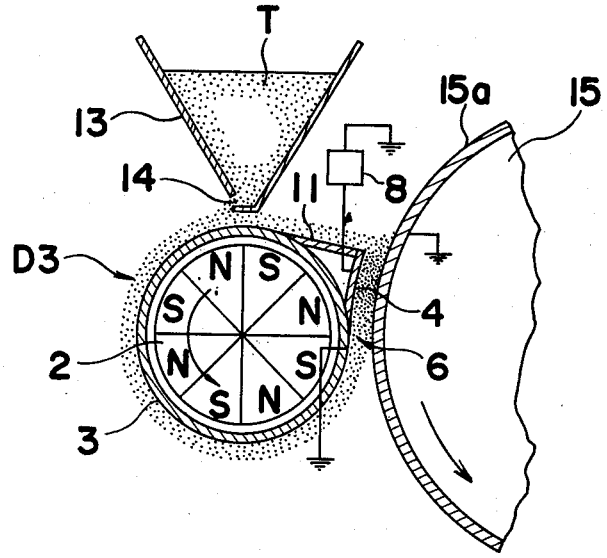
FIG. 4 is a view similar to FIG. 2, but particularly shows another modification thereof.

Referring further to FIG. 4 showing another modification of the developing apparatus of FIG. 2, the modified developing apparatus D3 differs from the embodiment of FIG. 2 in that the toner removing electrode 5 described as employed in the arrangement of FIG. 2 is dispensed with, removal of the toner particles responsible for the fogging in the non-latent image portion being achieved only by the magnetic binding force of the magnetic member 2, although the developing electrode 4 is connected to the biasing voltage source 8 in a similar manner to that described in connection with the embodiment of FIG. 2 for the excessive developing. It should be noted here that in the above case, the magnet member 2 employed should be powerful enough to readily remove the toner particles giving rise to fogging so that the removing of such toner particles is effected at a position 6 on the outer cylinder 3 whereat at which the surface of the outer cylinder 3 is closest to the photoreceptor surface 15*a*, i.e., at a position where the magnetic binding force of the magnet member 2 is the strongest. It should also be noted that in the modified developing apparatus D3 of FIG. 4 as described above, the outer cylinder 3 may either be of electrically conductive material or of electrically insulating material, since the removal of the toner particles T responsible for the fogging of the non-image portion is effected only through the magnetic binding force of the magnet member 2.

Figure 5:
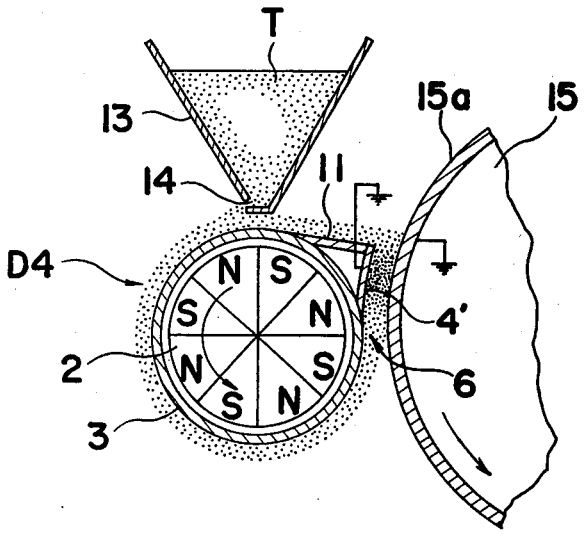
FIG. 5 is a view similar to FIG. 2, but particularly shows a further modification thereof.

In FIG. 5 showing a further modification of the developing apparatus D1 of FIG. 2, the modified developing apparatus D4 is particularly intended to effect excessive developing and removal of the toner particles responsible for the fogging only through adjustment of the magnetic binding force. More specifically, in the modified developing apparatus D4 of FIG. 5, the toner removing electrode 5 described as employed in the arrangement of FIG. 2 is also dispensed with, and the developing electrode 4' having a surface suitably curved to conform with the photoreceptor surface 15*a* and connected to the ground is supported, at its upper edge, in a position spaced from the surface of the outer cylinder 3 by the fixing plate 11 and at which the magnetic binding force of the magnet member 2 is weak, while the lower portion of the electrode 4' gradually approaches the outer cylinder 3 so as to contact the cylinder 3 at a position where the surface of the outer cylinder 3 is close to the photoreceptor surface 15*a*. It is to be noted that in the modified developing device D4, the removal of the toner particles causing the fogging is effected at the portion 6 on the outer cylinder 3 having the strongest magnetic binding force and at which the surface of the outer cylinder 3 is the closest to the photoreceptor surface 15*a* in a similar manner to that described in connection with the developing apparatus D3 of FIG. 4.

Figure 6:
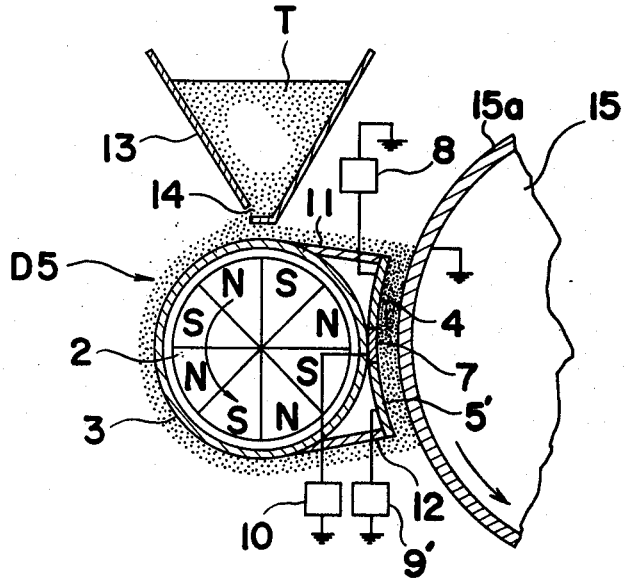
FIG. 6 is a view similar to FIG. 2, but particularly shows a still further modification thereof.

Referring to FIG. 6 showing a still further modification of the developing apparatus D1 of FIG. 2, in the modified developing apparatus D5, the toner removing electrode 5 in the arrangement of FIG. 2 is replaced by a similar electrode 5' supported in a position opposite to the developing electrode 4 by a fixing plate 12 and at which the photoreceptor surface 15*a* is spaced further from the surface of the outer cylinder 3, while a second developing electrode 7 is provided in the position at which the toner removing electrode 5 is disposed in the arrangement of FIG. 2. The biasing voltage source 8 is connected to the developing electrode 4, and another biasing voltage 10 is coupled to the second developing electrode 7 to apply developing expediting bias to the electrodes 4 and 7 for excessive developing, while still another biasing voltage source 9' is connected to the toner removing electrode 5' to apply developing suppression bias thereto for removal of the toner particles giving rise to the fogging. It should be noted here that, in the above arrangement, since the second developing electrode 7 is at a position at which the magnetic binding force is stronger than in the developing electrode 4, the biasing voltage source 10 should have a potential higher than that of the developing electrode 4, and that such second developing electrode 7 may be dispensed with if the excessive developing is sufficiently achieved solely by the developing electrode 4.

It is to be noted that in the modifications of FIGS. 4 to 6, since other constructions and functions of the developing apparatuses than those particularly described therein are similar to the construction and function of the embodiment of FIG. 2, a detailed description thereof is abbreviated for brevity.

Further, it is to be noted that the excessive developing and excessive toner removal are determined by the potential difference between the surface potential of the photoreceptor and the electrodes and also by the magnetic binding force. In the extreme case, the biasing voltage for excessive developing may have the same polarity as that of the electrostatic latent image or the biasing voltage for excessive toner removal may have a polarity opposite to that of the electrostatic latent image.

As is clear from the foregoing description, according to the present invention, since it is so arranged that the desirable excessive developing of high density is effected at least by the developing electrode for subsequent removal of the toner particles responsible for the fogging at the toner removing electrode, superior copied images of high density free from fogging in the non-image portions can be obtained without formation of "dimming or hazing" of the copied images during transferring, and thus the development employing the mono-component developer can be advantageously effected by a toner powder image transfer type copying apparatus with optimum results.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. A magnetic brush developing apparatus for use in a toner powder image transfer type electrophotographic copying machine, which comprises: a photosensitive member; a single outer cylinder fixedly disposed in spaced opposed relation to said photosensitive member; a magnet member rotatably accommodated in said outer cylinder for being rotatably driven; a toner container containing therein a mono-component developer composed of magnetically attractive toner particles and disposed adjacent said outer cylinder for supplying the toner particles onto said outer cylinder; a developing electrode plate on said outer cylinder and in spaced opposed relationship to the surface of said photosensitive member approximately equidistantly spaced from said photosensitive member and located upstream of the position at which the surface of said outer cylinder is closest to the surface of said photosensitive member an excessive developing region for causing the toner particles to be magnetically formed into a brush for transferring toner particles to said photosensitive member for developing the image portion of an electrostatic latent image formed on said photosensitive member with sufficient density; toner particle guide means extending from said outer cylinder to the upstream end of said developing electrode plate for guiding toner particles from said outer cylinder to the upstream end of said developing electrode plate; means connected to said apparatus in said excessive developing region for giving to said developing electrode plate a charge ranging from a charge equal to that of the reverse surface of the photosensitive member to a charge which biases said developing electrode plate with an opposite polarity to the polarity of said latent image, said outer cylinder and said photosensitive member downstream of said excessive developing region defining therebetween a toner removing region for removing toner particles adhering at least to the non-image portions of the electrostatic latent image, said magnet member in said outer cylinder being closer to said photosensitive member in said toner removing region than in said excessive developing region for exerting a substantially stronger magnetic force on toner particles in said toner removing region than in said excessive developing region; and further means connected to said apparatus in said toner removing region for giving to said apparatus on the side of said toner removing region on which said outer cylinder is positioned a charge ranging from a charge equal to that of said photosensitive member to a charge which biases said side of the toner removing region with the same polarity of said latent image.

2. A magnetic brush developing apparatus as claimed in claim 1, wherein said excessive developing region is spaced from said magnet member for causing the magnetic force exerted by said magnet member on the surface of said photosensitive member at said excessive developing region to be relatively small as compared with the magnetic force exerted by said magnet member at the position at which the surface of the outer cylinder is closest to the surface of the photosensitive member, and said developing electrode plate being electrically grounded.

3. A magnetic brush developing apparatus as claimed in claim 1, wherein said means for giving a charge to said developing electrode plate is a voltage source connected to said developing electrode plate for applying biasing voltage having a polarity opposite to that of the electrostatic latent image to said developing electrode plate.

4. A magnetic brush developing apparatus as claimed in claim 1, wherein said toner removing region is at the position where the surface of said outer cylinder is closest to the surface of said photosensitive member for causing said magnet to exert in said toner removing region a magnetic force for attracting the toner particles which is made stronger than the electrostatic force for attracting the toner particles to the non-image portions on said photosensitive member.

5. A magnetic brush developing apparatus for use in a toner powder image transfer type electrophotographic copying machine, which comprises: a photosensitive member; a single outer cylinder fixedly disposed in spaced opposed relation to said photosensitive member; a magnet member rotatably accommodated in said outer cylinder for being rotatably driven; a toner container containing therein a mono-component developer composed of magnetically attractive toner particles and disposed adjacent said outer cylinder for supplying the toner particles onto said outer cylinder; a developing electrode plate on said outer cylinder and in spaced opposed relationship to the surface of said photosensitive member approximately equidistantly spaced from said photosensitive member and located upstream of the position at which the surface of said outer cylinder is closest to the surface of said photosensitive member, an excessive developing region for causing the toner particles to be magnetically formed into a brush for transferring toner particles to said photosensitive member for developing the image portion of an electrostatic latent image formed on said photosensitive member with sufficient density; toner particle guide means extending from said outer cylinder to the upstream end of said developing electrode plate for guiding toner particles from said outer cylinder to the upstream end of said developing electrode plate; means connected to said apparatus in said excessive developing region for giving to said developing electrode plate a charge ranging from a charge equal to that of the reverse surface of the photosensitive member to a charge which biases said developing electrode plate with an opposite polarity to the polarity of said latent image; a toner removing electrode plate disposed on said outer cylinder downstream of said developing electrode plate, said toner removing electrode plate and said photosensitive member downstream of said excessive developing region defining therebetween a toner removing region for removing toner particles adhering at least to the non-image portions of the electrostatic latent image; and a voltage source connected to said toner removing electrode plate for applying a biasing voltage thereto having the same polarity as that of the electrostatic latent image.

6. A magnetic brush developing apparatus as claimed in claim 1 or claim 5 wherein said magnetically attractive toner particles are of high resistance electrically conductive toner which is selected from the group consisting of electrically conductive and magnetically attractive toners capable of being used for developing by a developing method employing mono-component developer and which has a comparatively high resistivity so as to be transferred by ordinary corona transfer.

7. A magnetic brush developing apparatus as claimed in claim 1 in which said developing electrode plate is electrically grounded, and said toner removing region is at the position where the surface of said outer cylinder is closest to the surface of said photosensitive member for causing said magnet member to exert in said toner removing region a magnetic force for attracting the toner particles which is made stronger than the electrostatic force for attracting the toner particles to the non-image portions on said photosensitive member.

8. A magnetic brush developing apparatus as claimed in claim 1, wherein said means for giving a charge to said developing electrode plate is a voltage source connected to said developing electrode plate for applying a biasing voltage having a polarity opposite to that of the electrostatic latent image on said photosensitive member, and said toner removing region is at the position where the surface of said outer cylinder is closest to the surface of said photosensitive member for causing said magnet member to exert in said toner removing region a magnetic force for attracting the toner particles which is stronger than the electrostatic force for attracting the toner particles to the non-image portions on said photosensitive member.

9. A magnetic brush developing apparatus as claimed in claim 5, wherein said developing electrode plate is electrically grounded.

10. A magnetic brush developing apparatus as claimed in claim 5, wherein said means for giving a charge to said developing electrode is a voltage source connected to said developing electrode plate for applying thereto a biasing voltage having a polarity opposite to that of the electrostatic latent image on said photosensitive member.

11. A magnetic brush developing device for developing an electrostatic latent image supported on a movable electrostatic latent image support member with mono-component magnetizable toner which comprises:

(a) a developing electrode plate extending along and spaced from the surface of said electrostatic latent image support member; particle toner guide means extending to the upstream end of said developing electrode plate for guiding toner particles to the upstream end of said developing electrode plate; and (b) a single rotatably driven magnet roller positioned adjacent said developing electrode plate and in spaced opposite relation to said electrostatic latent image support member for causing the magnetizable toner to be magnetically attracted in the form of magnetic bristles on the surface of said developing electrode plate facing said electrostatic latent image support member and also for transporting said magnetizable toner in a predetermined direction, said magnet roller being located at the forward end of said developing electrode plate with respect to the direction of movement of said electrostatic latent image support member.

12. A magnetic brush developing device as claimed in claim 11, wherein said magnetizable toner has a sufficiently high resistance value to achieve optimum toner image transfer.

13. A magnetic brush developing device as claimed in claim 11, wherein said developing electrode plate has at least two portions sequentially positioned in the direction of movement of said image support member and respectively having different potentials.

14. A magnetic brush developing device as claimed in claim 13, wherein the portion of said developing electrode plate located at a rearward position with respect to the direction of movement of said electrostatic latent image support member has a potential opposite in polarity to the electrostatic latent image.

15. A magnetic brush developing device as claimed in claim 13, wherein the portion of said developing electrode plate located at a forward position with respect to the direction of movement of said electrostatic latent image support member has a potential with the same polarity as the electrostatic latent image.

16. A magnetic brush developing device for developing an electrostatic latent image supported on a movable electrostatic latent image support member with a mono-component magnetizable toner which comprises:

(a) a developing electrode plate extending along and spaced from the surface of said electrostatic latent image support member and having at least two portions respectively having different potentials, one of said portions being located at a position upstream of the other portion relative to the direction of movement of said electrostatic latent image support member and having a potential opposite in polarity to the electrostatic latent image, and the other of said portions being located at a position downstream relative to the direction of movement of said electrostatic latent image support member and having a potential with the same polarity as the electrostatic latent image; toner particle guide means extending to the upstream end of said one portion of said developing electrode plate for guiding toner particles to the upstream end of said one portion of said developing electrode plate; and (b) a single rotatably driven magnet roller positioned adjacent said developing electrode plate and in spaced opposed relation to said electrostatic latent image support member for causing the magnetizable toner to be magnetically attracted in the form of magnetic bristles on the surface of said developing electrode plate facing said electrostatic latent image support member and also for transporting said magnetizable toner in a predetermined direction.

17. A magnetic brush developing device as claimed in claim 16, wherein said magnetizable toner has a sufficiently high resistance value to achieve optimum toner image transfer.

18. A magnetic brush developing device as claimed in claim 16, wherein said magnet roller is located approximately at the central portion of said developing electrode plate with respect to the direction of movement of said electrostatic latent image support member.

* * * * *